US011325232B2

(12) United States Patent
Lee et al.

(10) Patent No.: US 11,325,232 B2
(45) **Date of Patent: *May 10, 2022**

(54) TORQUE WRENCH WITH SHOCK ABSORPTION

(71) Applicant: Snap-on Incorporated, Kenosha, WI (US)

(72) Inventors: Nathan J Lee, Escondido, CA (US); Jonathan J. Olson, Long Beach, CA (US); Daniel A. Phipps, Round Rock, TX (US); Gregory E. Reinecker, Round Rock, TX (US); Peter A. Kaltenbach, Austin, TX (US)

(73) Assignee: Snap-on Incorporated, Kenosha, WI (US)

( * ) Notice: Subject to any disclaimer, the term of this patent is extended or adjusted under 35 U.S.C. 154(b) by 379 days.

This patent is subject to a terminal disclaimer.

(21) Appl. No.: 16/352,377

(22) Filed: Mar. 13, 2019

(65) Prior Publication Data

US 2019/0210200 A1 Jul. 11, 2019

Related U.S. Application Data

(63) Continuation of application No. 13/936,683, filed on Jul. 8, 2013, now Pat. No. 10,335,935.

(51) Int. Cl.
*B25B 23/142* (2006.01)

(52) U.S. Cl.
CPC ..... *B25B 23/1422* (2013.01); *B25B 23/1425* (2013.01)

(58) Field of Classification Search
CPC ..... B25B 23/1422; B25B 23/1425
See application file for complete search history.

(56) References Cited

U.S. PATENT DOCUMENTS

| | | | |
|---|---|---|---|
| 4,800,973 | A | 1/1989 | Angel |
| 7,082,865 | B2 | 8/2006 | Reynertson, Jr. |
| 7,107,884 | B2 | 9/2006 | Cutler et al. |
| 7,157,882 | B2 | 1/2007 | Johnson et al. |
| 7,649,337 | B2 | 1/2010 | Uehlein-Proctor et al. |

(Continued)

FOREIGN PATENT DOCUMENTS

| | | |
|---|---|---|
| CA | 2283552 | 10/2001 |
| CN | 101825928 | 9/2010 |

(Continued)

OTHER PUBLICATIONS

Chinese Office Action for Application No. 201410322202.8 dated Jul. 19, 2017, 7 pages.

(Continued)

*Primary Examiner* — Hadi Shakeri
(74) *Attorney, Agent, or Firm* — Seyfarth Shaw LLP

(57) ABSTRACT

The present disclosure relates to a tool including one or more shock absorption components disposed in the tool and adapted to protect various components of the tool in the event the tool is dropped or otherwise sustains an impact force. In an embodiment, the tool includes shock absorption foam disposed above and below an electronic display. The tool may also include a shock absorption component disposed under an end cap of the tool to absorb a shock or impact force to the tool when the tool is dropped on the end cap.

10 Claims, 5 Drawing Sheets

(56) References Cited

U.S. PATENT DOCUMENTS

| | | | | |
|---|---|---|---|---|
| 9,085,072 | B2 | 7/2015 | Anjanappa et al. | |
| 9,308,633 | B2 | 4/2016 | Gharib | |
| 2002/0007676 | A1 | 1/2002 | Ward et al. | |
| 2003/0094081 | A1 | 5/2003 | Becker et al. | |
| 2003/0154829 | A1 | 8/2003 | Lin Wu | |
| 2004/0040388 | A1 | 3/2004 | Hsien | |
| 2004/0255733 | A1 | 12/2004 | Reynertson, Jr. | |
| 2006/0011023 | A1 | 1/2006 | Hsieh | |
| 2008/0006130 | A1 | 1/2008 | Hsieh | |
| 2008/0173139 | A1 | 7/2008 | Miyazaki et al. | |
| 2008/0314209 | A1 | 12/2008 | Chen | |
| 2009/0178519 | A1 | 7/2009 | Hsieh | |
| 2012/0111159 | A1 | 5/2012 | Wu | |
| 2012/0111160 | A1 | 5/2012 | Wu | |
| 2014/0260837 | A1 | 9/2014 | Gauthier et al. | |
| 2016/0140432 | A1* | 5/2016 | Lehovetzki ..... | B25G 1/102 235/492 |

FOREIGN PATENT DOCUMENTS

| | | |
|---|---|---|
| CN | 202318090 | 11/2012 |
| TW | 325900 | 1/2008 |
| WO | 2012134469 | 10/2012 |

OTHER PUBLICATIONS

Taiwa Office Action dated Nov. 23, 2015, 2 pages.
UK Combined Search and Examination Report dated Dec. 7, 2015, 5 pages.
Taiwan Search Report dated Nov. 3, 2015, 1 page.
Chinese First Office Action dated Jul. 27, 2015, 10 pages.
Australian Examination Report No. 1 dated Jun. 9, 2015, 3 pages.

* cited by examiner

TORQUE WRENCH WITH SHOCK ABSORPTION

CROSS REFERENCE TO RELATED APPLICATIONS

The present application is a continuation of and claims priority to U.S. patent application Ser. No. 13/936,683, filed on Jul. 8, 2013, entitled Torque Wrench With Shock Absorption, the contents of which are incorporated by reference herein in their entirety.

TECHNICAL FIELD OF THE INVENTION

The present application relates to tools adapted to apply torque to a work piece. More particularly, the present application relates to electronic torque wrenches that include shock absorption characteristics.

BACKGROUND OF THE INVENTION

Electronic torque wrenches are commonly used in automotive and industrial applications to apply a predetermined amount of torque to a work piece, such as a threaded fastener. For example, a fastening system may require tightening components such as a nut and bolt to a desired amount of torque or within a desired torque range. Securing the fastening components at a desired torque setting allows for secure attachment of the components and structures related thereto without under-tightening or over-tightening the components. Under-tightening the components could result in unintended disengagement of the components. Over-tightening the components could make disengaging the components difficult or could damage the components or fasteners. To prevent under-tightening or over-tightening a torque measurement can be made while tightening the components, for example, a nut to a bolt, to meet a target torque setting or to apply a torque within a desired torque range, such as a torque wrench.

Such torque wrenches are calibrated on a regular basis and have internal components that may be subject to damage if the wrench is accidentally dropped or impacted against another item. However, since torque wrenches are commonly used in automotive or industrial applications, accidental dropping or impacting the wrench occurs frequently, typically resulting in damage to wrench components or aversely affecting calibration.

SUMMARY OF THE INVENTION

The present application discloses a tool, for example, a torque wrench, that includes one or more shock absorption components disposed in the tool to protect various components of the tool in the event the tool is dropped or otherwise sustains an impact force. In an embodiment, the tool includes shock absorption foam disposed above and below an electronic display or liquid-crystal display (LCD). The tool may also include another shock absorption component disposed under an end cap of the tool to absorb a shock or impact force to the tool when the tool is dropped on the end cap. These shock absorption components may also serve to separate and protect electronic components of the tool and increase the life of the tool.

In an embodiment, a tool includes a drive head adapted to apply an amount of torque to a work piece, a control housing extending from the drive head, and a handle portion extending from the control housing. A display is disposed in the control housing, and a shock absorption component is disposed above the display between the display and the control housing. A second shock absorption component may also be disposed below the display between the display and a controller of the tool.

In another embodiment, a tool includes a drive head adapted to apply an amount of torque to a work piece, a control housing extending from the drive head, and a handle portion extending from the control housing to a first end. A flange is disposed in the handle portion proximate to the first end, and a battery tray is disposed in the handle portion and has an end proximal the first end. A shock absorption component is disposed between the end of the battery tray and the flange. An end cap is coupled to the end of the battery tray. The battery tray and the end cap are adapted to slide within the handle portion and the shock absorption component is adapted to compress upon application of an impact force to the end cap.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

Figure 1:
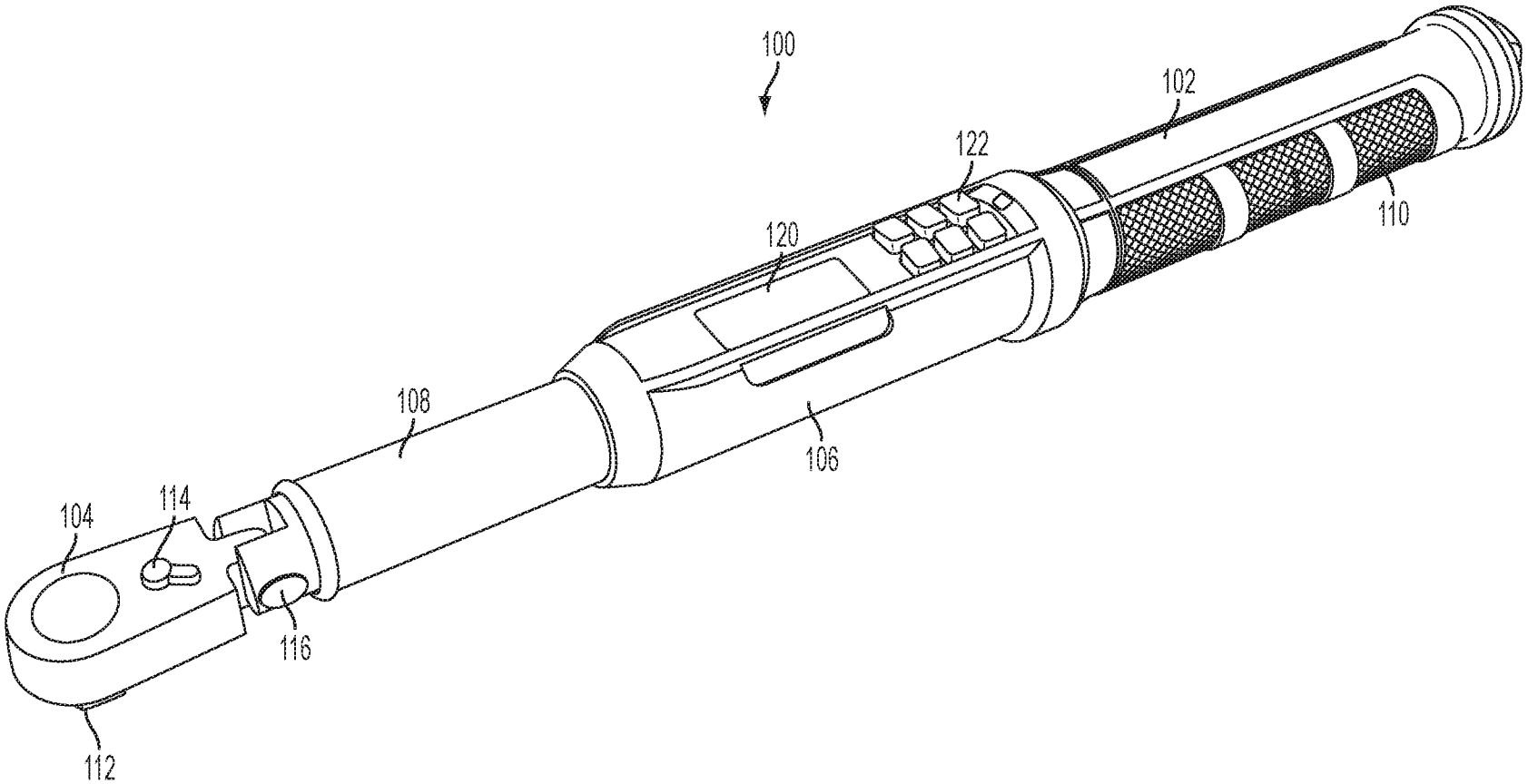
FIG. 1 illustrates a perspective view of a tool in accordance with an embodiment of the present application.
Figure 2:
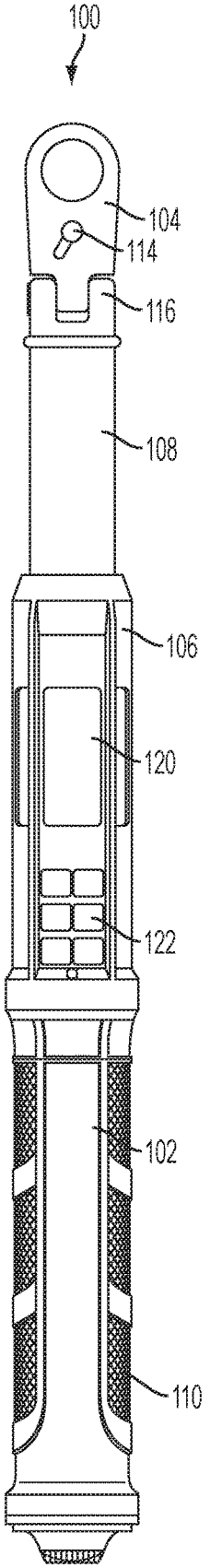
FIG. 2 illustrates a top elevation view of the tool of FIG. 1 in accordance with an embodiment of the present application.
Figure 3:
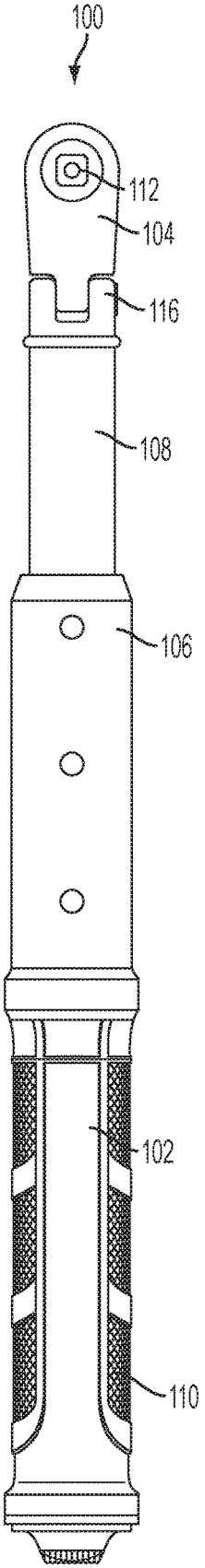
FIG. 3 illustrates a bottom elevation view of the tool of FIG. 1 in accordance with an embodiment of the present application.
Figure 4:
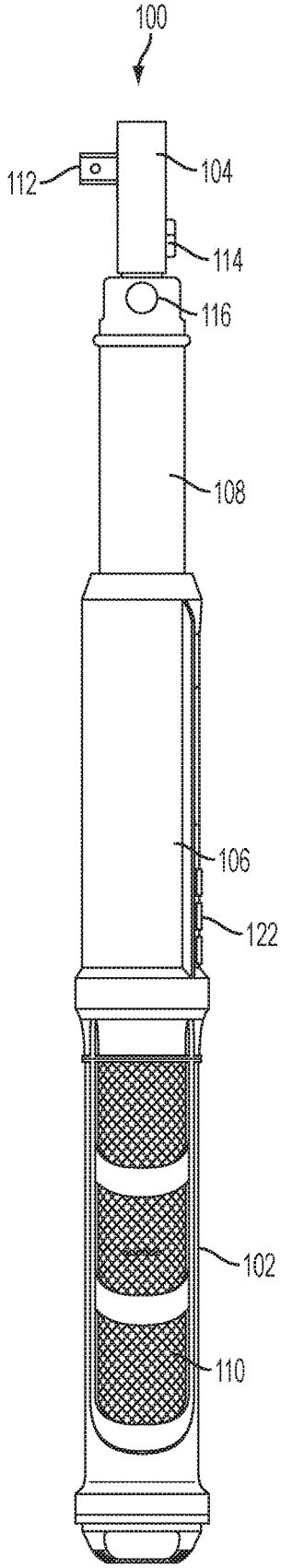
FIG. 4 illustrates a first side elevation view of the tool of FIG. 1 in accordance with an embodiment of the present application.
Figure 5:
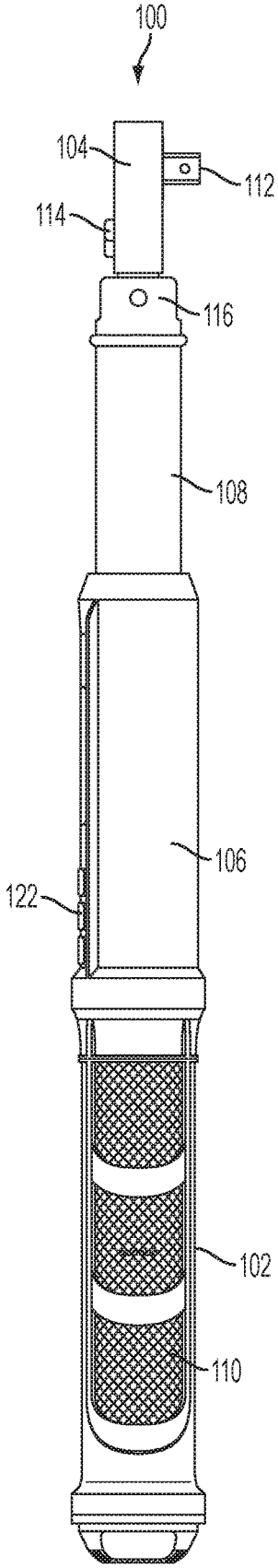
FIG. 5 illustrates a second side elevation view of the tool of FIG. 1 in accordance with an embodiment of the present application.

It should be understood that the comments included in the notes as well as the materials, dimensions and tolerances discussed therein are simply proposals such that one skilled in the art would be able to modify the proposals within the scope of the present application.

DETAILED DESCRIPTION

While this invention is susceptible of embodiments in many different forms, there is illustrated in the drawings, and herein described in detail, an embodiment of the invention with the understanding that the present disclosure is to be considered as an exemplification of the principles of the invention and is not intended to limit the broad aspect of the invention to embodiments illustrated.

The present application discloses an electronic torque tool that includes one or more shock absorption components disposed in the tool and adapted to protect various components of the tool in the event the tool is dropped or otherwise sustains an impact force. In an embodiment, the tool includes shock absorption foam disposed above and below an electronic display or liquid-crystal display (LCD), thereby protecting the display. The tool may also include a shock absorption component disposed under an end cap of the tool to absorb a shock or impact force to the tool when the tool is dropped on or adjacent to the end cap. These shock absorption components may also serve to separate and protect various electronic components of the tool and increase the operable life of the tool.

As illustrated in FIGS. 1-5, a tool 100 is disclosed. As shown herein, the tool 100 is depicted as an electronic torque wrench, but it will be understood that the present application can be used with any type of tool that is adapted to apply torque to a work piece, such as, for example, a threaded fastener. In an embodiment, the tool 100 includes a handle 102, a drive head 104, a control housing 106 between the handle 102 and the drive head 104, and a neck portion 108 between the control housing 106 and the drive head 104. The handle 102 can include a grip 110 for gripping the handle 102 by a user. Although the grip 110 is illustrated as being located along a length of the handle 102, the grip 110 may be positioned at other locations along the handle 102, or alternately, the handle 102 may be fitted with two or more grips for gripping.

The drive head 104 of the tool 100 can include a receiving area or drive lug 112 that, directly or indirectly, applies torque to a work piece. For example, the drive head 104 can be coupled to a socket adapted to couple to a hex-bolt fastener to apply torque to the fastener in a well-known manner. The drive head 104 can also include a reversing lever 114 and a pivot joint 116. The reversing lever 114 may be connected to a pawl (not shown) to selectively operate the tool 100 in a predetermined drive direction in a well-known manner. The pivot joint 116 couples the drive head 104 to the neck portion 108 and may allow the handle 102 to pivot relative to the drive head 104 to make usability easier for certain fasteners located in hard to reach areas, for example.

The control housing 106 be disposed in or fixedly attached to the handle 102. The control housing 106 may house a controller, such as controller 118 illustrated in FIG. 6, operatively associated with the tool. The control housing 106 may also house a display 120 for displaying information related to a torque application, and a user input interface 122 for inputting instructions and modifying settings of the tool or interacting with menus presented on the display 120.

The user input interface 122 allows the user to input information, data, and/or commands into the tool 100. By way of example, the user input interface 122 can include a keyboard, mouse, touch screen, audio recorder, audio transmitter, member pad, or other device that allows for the entry of information from a user. As illustrated in FIG. 1, in an embodiment, the user input interface 122 can include buttons, e.g., up/down control buttons, an "enter" key, a "units" key and other buttons. In one example, the buttons allow the user to input a torque setting.

In an illustrative embodiment, the display 120 can display various information for the user to view and interpret, for example, text or graphics, or information entered into the user input interface 122. By way of example, the display 120 can include a liquid crystal display (LCD), organic light emitting diode (OLED) display, plasma screen, or other kind of black and white or color display that allows the user to view and interpret information.

Figure 6:
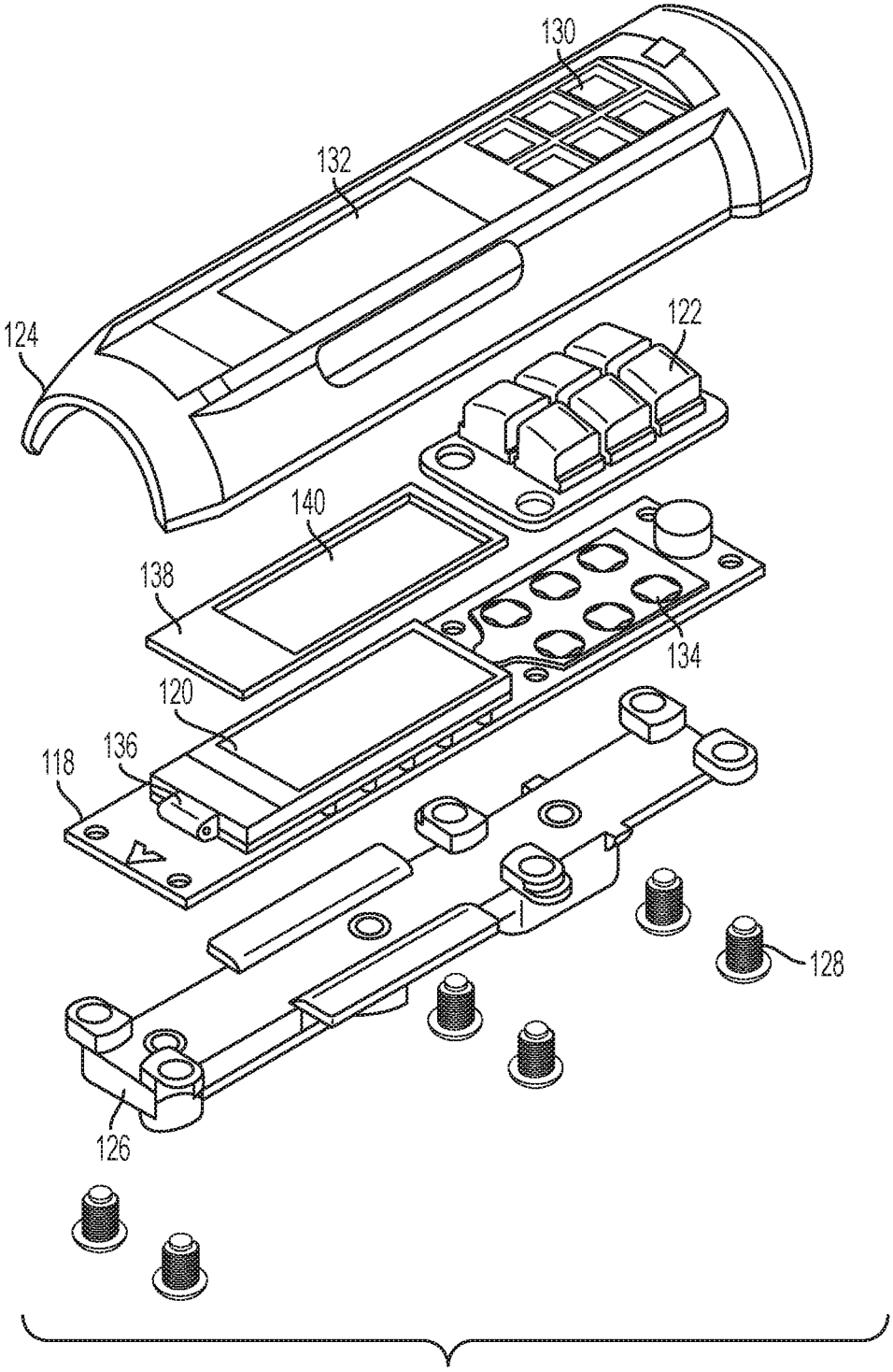
FIG. 6 illustrates an exploded view of a control housing of the tool of FIG. 1 in accordance with an embodiment of the present application.

As illustrated in FIG. 6, the control housing 106 includes a first housing portion 124 and a second housing portion 126 that may be coupled together using fasteners 128. The first housing portion 124 may include one or more first apertures 130 adapted to receive corresponding buttons of the input interface 122. The first housing portion 124 may also include a second aperture 132, which may include a clear plastic or glass window, adapted to allow the user to view the display 120 through the first housing portion 124.

A controller 118 is disposed in the control housing between the first housing portion 124 and the second housing portion 126, and is operatively connected to the display 120 and the input interface 122, for example, through the use of contact pads 134. In an embodiment, the controller 118 is a printed circuit board (PCB) and is carried by the second housing portion 126. The second housing portion 126 may isolate the fasteners 128 from the controller 118.

In an embodiment, a first shock absorption component 136 is disposed between the display 120 and the controller 118. A second shock absorption component 138 may also be disposed between the display 120 and the first housing portion 124. As illustrated, the second shock absorption component 138 includes an aperture 140 adapted to allow the display 120 to be unobstructed and viewable through the second shock absorption component 138.

The shock absorption components 136 and 138 may serve to protect the electronic components, for example, the display 120 and the controller 118 from impact forces that may result from the tool 100 being dropped, falling, or otherwise sustaining an impact force. This allows the tool 100 to be more durable and have an increased operable life when compared to prior art tools.

The controller 118 may include circuitry of known construction to sense and record an amount of torque applied by the tool 100 to a work piece during a particular torque application. The controller 118 may also include a volatile or re-writeable memory for storing input and recorded torque amounts for later retrieval and/or transmission to other devices.

Figure 7:
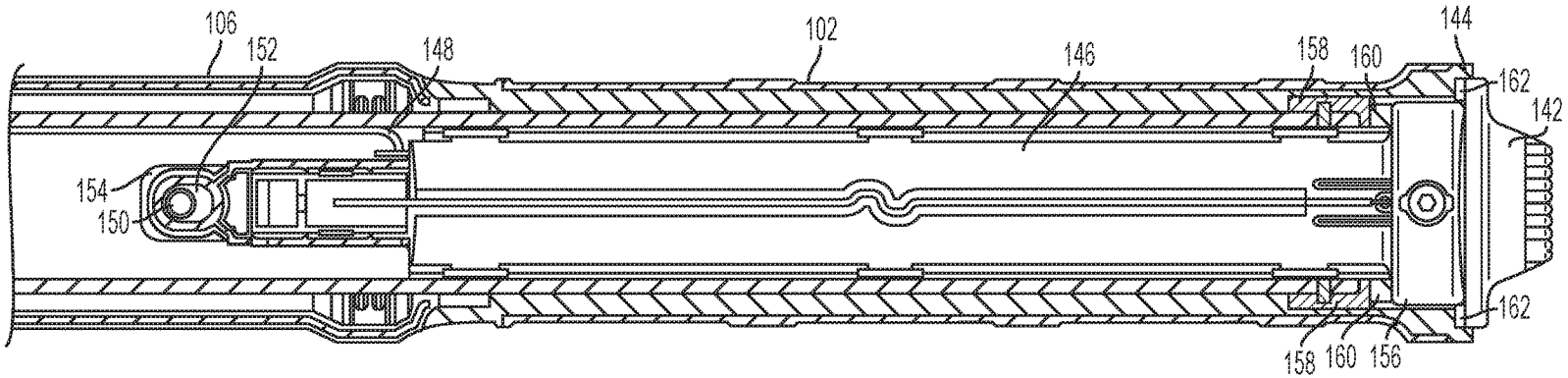
FIG. 7 illustrates a cut-away view taken along of a handle portion of the tool of FIG. 1 in accordance with an embodiment of the present application.

FIG. 7 illustrates a cut-away view of the handle potion 102 of the tool 100. In an embodiment, the tool 100 includes an end cap 142 disposed at an end 144 of the handle portion 102 opposite the control housing 106. The handle portion 102 may be hollow and a battery tray 146 may be disposed in the handle portion 102. The battery tray 146 may extend along a length of the handle portion 102 and into the control housing 106. The battery tray 146 may accept a power source, for example, a battery. The power source may be electrically connected to the controller 118 by wiring 148.

A protrusion 150 may extend into the control housing 106 and mate with a slot 152 in a first end 154 of the battery tray 146 and retain the battery tray 146 within the handle portion 102.

The slot 152 may be sized larger than the protrusion 150 to allow the battery tray 146 to slide within the handle portion 102. A second end 156 opposite the first end 154 of the battery tray 146 is located at the end 144 of the handle portion 102. The handle portion 102 may also include a flange 158 that radially extends into the handle portion 102. A third shock absorption component 160 may be disposed in the end 144 of the handle portion 102 between the flange 158 and the second end 156 of the battery tray 146.

As illustrated, the end cap 142 threadingly mates with the second end 156 of the battery tray 146. A small gap 162 is present between the end cap 142 and the end 144 of the handle portion 102. Additionally, the slot 152 provides a gap to allow the battery tray 146 to slide within the handle portion 102. These gaps may be a result of the third shock absorption component 160 being disposed between the flange 158 and the second end 156 of the battery tray 146.

This allows the end cap 142 and the battery tray 146 to slide into the handle portion 102 and compress the third shock absorption component 160 when a force is applied to the end cap 142. For example, when the tool 100 is dropped on the end cap 142, the end cap 142 and battery tray 146 shift further into the handle portion 102 and the third shock absorption component 160 compresses to absorb the shock. This allows the force of the shock to be absorbed by the third shock absorption component 160 and the battery tray 146 and not transferred to the electronics, for example, the controller 118, display 120, and user input interface 122 of the tool 100.

The shock absorption components described above allow the tool 100 to absorb impact forces and minimize the transfer of such impact forces to the electronics of the tool 100. This can increase the operable life of the tool 100. The shock absorption components may be a foam, for example, made of a polymer, such as polyethylene, polyethane, polyurethane, and other materials capable of absorbing an impact force or shock.

As discussed above, the tools are electronic torque wrenches. However, the tools can be other tools or mechanisms that may be subject to dropping or impact forces without departing from the spirit and scope of the present application.

The controller 118 may also include one or more of a processor for controlling operations of the controller 118, a memory for storing data and/or computer programs, a torque sensor to measure and sense a torque applied by the tool 100, and an interface for transmitting and/or receiving data relating to the tool 100 to external sources. The above components of the controller 118 can be operably coupled together, directly or indirectly, by hardwired connections, wireless connections and/or other known coupling means.

The processor may facilitate communication between the various components of the tool 100 and control operation of the electrical components of the tool 100. The processor can be a special purpose or general type of processor or multiple processors, for example, a microprocessor, a single-core or a multi-core processor. In an illustrative embodiment, the processor is configured to provide feedback to the user when a desired amount of torque or set amount of torque is reached, for example, through visual, audible or tactile well-known means.

In an illustrative embodiment, the memory can store data or computer programs for use in the tool 100. For example, the memory can store calibration factors, torque target values, and other such data. The memory can also store an operating system for the controller 118 or other software or data that may be necessary for the tool 100 to function. Without limitation, the memory can include non-transitory computer-readable recording medium, such as a hard drive, DVD, CD, flash drive, volatile or non-volatile memory, RAM, or other type of data storage.

The torque sensor measures a magnitude of torque applied by the tool 100. The torque sensor may be a known mechanism capable of measuring torque. For example, the torque sensor may be a strain gauge or load cell attached to a torsion rod.

The interface can be a device capable of transmitting data from the tool 100 or capable of receiving data within the tool 100 from an external data source. By way of example, the interface can be a hard wire connection, such as an insulated copper wire or optical fiber, or a radio transmission antenna, cellular antenna, infrared, acoustic, radio frequency (RF), or other type of wired or wireless interface capable of communicating with an external device.

The matter set forth in the foregoing description and accompanying drawings is offered by way of illustration only and not as a limitation. While particular embodiments have been illustrated and described, it should be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A tool having a handle portion and a drive head, the tool comprising:

a control housing extending from the drive head and including first and second housing portions;

a controller disposed in the control housing;

a display disposed between the first housing portion and the controller, the display having opposing first and second surfaces, the first surface facing the first housing portion and the second surface facing the controller and the second housing portion; and first and second shock absorption materials adapted to absorb impact forces to protect the display when the tool experiences an impact force, the first shock absorption material is disposed between the second surface and the controller, and the second shock absorption material is disposed between the first surface and the first housing portion.

2. The tool of claim 1, wherein the second shock absorption material at least partially surrounds a viewable area of the display and includes an aperture allowing a view of at least a portion of the viewable area of the display.

3. The tool of claim 1, further comprising a user input interface disposed in the control housing and adapted to receive an input from a user.

4. The tool of claim 3, wherein the user input interface includes a button selectable by the user.

5. The tool of claim 1, further comprising a battery tray disposed in the handle portion.

6. The tool of claim 5, further comprising an end cap coupled to an end of the battery tray.

7. The tool of claim 5, further comprising a protrusion extending radially into the control housing, wherein the battery tray includes a slot adapted to matingly engage the protrusion.

8. The tool of claim 5, wherein the battery tray is adapted to slide within the handle portion.

9. The tool of claim 1, further comprising a clear window disposed in an aperture in the first housing portion, wherein the clear window is adapted to allow the display to be viewable through the first housing portion.

10. The tool of claim 1, wherein the first and second shock absorption materials are foam.

* * * * *